US011117378B2

(12) United States Patent
Dinares Argemi et al.

(10) Patent No.: US 11,117,378 B2
(45) Date of Patent: Sep. 14, 2021

(54) GUIDE BAR DETERMINATION

(71) Applicant: HEWLETT-PACKARD DEVELOPMENT COMPANY, L.P., Spring, TX (US)

(72) Inventors: Marian Dinares Argemi, Sant Cugat del Valles (ES); Francesc Tarrida Tirado, Sant Cugat del Valles (ES); Carlos Herrero Saez, Sant Cugat del Valles (ES); Macia Sole Pons, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 173 days.

(21) Appl. No.: 16/478,801

(22) PCT Filed: May 1, 2017

(86) PCT No.: PCT/US2017/030379
§ 371 (c)(1),
(2) Date: Jul. 17, 2019

(87) PCT Pub. No.: WO2018/203873
PCT Pub. Date: Nov. 8, 2018

(65) Prior Publication Data
US 2021/0129539 A1 May 6, 2021

(51) Int. Cl.
*B41J 2/165* (2006.01)
*B41J 2/175* (2006.01)
(Continued)

(52) U.S. Cl.
CPC ..... *B41J 2/16535* (2013.01); *B41F 35/00* (2013.01); *B41J 2/1752* (2013.01);
(Continued)

(58) Field of Classification Search
CPC B41J 2/16535; B41J 2/16538; B41J 2/16544; B41J 2/16579; B41J 2/16582;
(Continued)

(56) References Cited

U.S. PATENT DOCUMENTS 4,369,456 A * 1/1983 Cruz-Uribe ..... B41J 2/16535 347/19
4,829,318 A 5/1989 Racicot et al.
(Continued)

FOREIGN PATENT DOCUMENTS

DE 102009002244 A1 10/2010
EP 0685419 B1 6/1998

OTHER PUBLICATIONS

Bruijnen, D.; "Design of a Printhead Alignment Sensor for a Temperature Varying Environment"; Jun. 14-16, 2006; http://ieeexplore.ieee.org/document/1655387/.

*Primary Examiner* — Anh T Vo
(74) *Attorney, Agent, or Firm* — HP Inc. Patent Department

(57) ABSTRACT

An example service station system may include a guide bar to provide tension on web material. An example print apparatus may include a sensor mounted to a carriage and a controller to use data from the sensor to identify that the web material is incorrectly routed with reference to the guide bar.

20 Claims, 5 Drawing Sheets

(51) Int. Cl.
*B41F 35/00* (2006.01)
*B41J 2/44* (2006.01)
*B41J 2/38* (2006.01)

(52) U.S. Cl.
CPC ..... *B41J 2/17553* (2013.01); *B41J 2/38* (2013.01); *B41J 2/44* (2013.01); *B41J 2002/1655* (2013.01); *B41P 2235/24* (2013.01)

(58) Field of Classification Search
CPC .... B41J 2/16585; B41J 2/16588; B41J 29/17; B41J 29/38; B41F 35/00
See application file for complete search history.

(56) References Cited

U.S. PATENT DOCUMENTS

| | | | | |
|---|---|---|---|---|
| 5,574,485 | A * | 11/1996 | Anderson | B41J 2/16552 134/1 |
| 5,992,969 | A | 11/1999 | Arminana Terrasa et al. | |
| 6,350,012 | B1 | 2/2002 | Sarkissian et al. | |
| 6,568,787 | B1 | 5/2003 | Girones et al. | |
| 6,761,428 | B2 | 7/2004 | Agarwal et al. | |
| 7,017,489 | B2 | 3/2006 | Perault et al. | |
| 7,963,631 | B2 | 6/2011 | Albertalli et al. | |
| 8,002,382 | B2 | 8/2011 | Steinfield et al. | |
| 9,004,631 | B1 * | 4/2015 | Folkins | B41J 2/16508 347/9 |
| 9,676,195 | B2 * | 6/2017 | Coma Vives | B41J 2/16547 |
| 9,919,531 | B2 * | 3/2018 | Mataki | B41J 29/38 |
| 2007/0174896 | A1 | 7/2007 | Furuya et al. | |

* cited by examiner

GUIDE BAR DETERMINATION

BACKGROUND

Images are processed for use with computing machines, such as a print apparatus. A print apparatus, for example, may use control data based on processed image data to reproduce a physical representation of an image by operating a print fluid ejection system according to the control data. Components of a print apparatus, such as a fluid ejection device, may be serviced to improve print quality and/or the life of the component, for example. Some print apparatus include a mechanism, such as a service station, to perform various service routines.

DETAILED DESCRIPTION

Figure 1:
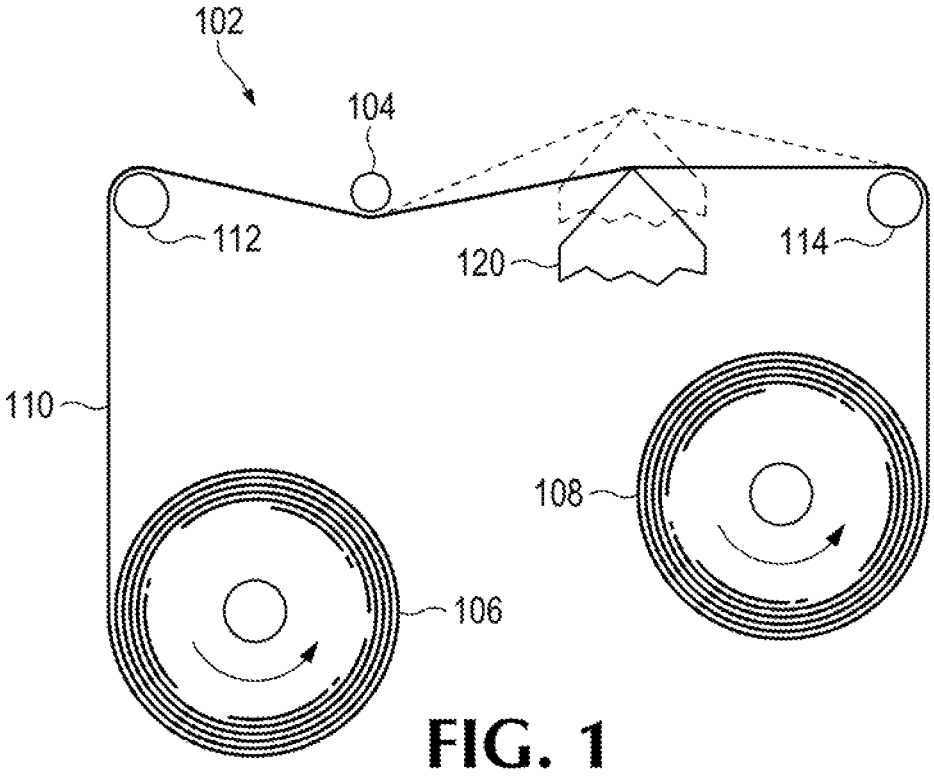
FIG. 1 is a side view depiction of an example service station system.

In the following description and figures, some example implementations of print apparatus, service station systems, and/or methods of determining routing of a web material are described. In examples described herein, a "print apparatus" may be a device to print content on a physical medium (e.g., paper, textile, a layer of powder-based build material, etc.) with a print material (e.g., ink or toner). For example, the print apparatus may be a wide-format print apparatus that prints latex-based print fluid on a print medium, such as a print medium that is size A2 or larger. The physical medium may printed on from sheets or a web roll. In the case of printing on a layer of powder-based build material, the print apparatus may utilize the deposition of print materials in a layer-wise additive manufacturing process. A print apparatus may utilize suitable print consumables, such as ink, toner, fluids or powders, or other raw materials for printing. In some examples, a print apparatus may be a three-dimensional (3D) print apparatus. An example of fluid print material is a water-based latex ink ejectable from a print head, such as a piezoelectric print head or a thermal inkjet print head. Other examples of print fluid may include dye-based color inks, pigment-based inks, solvents, gloss enhancers, fixer agents, and the like.

A print apparatus may include a service station to perform service routines on a component of the print apparatus. For example, a service station may include a wiping system and/or scraping system to remove excess print fluid from the fluid ejection device of the print apparatus. A service station may include a web material to use for wiping the fluid ejection device. The web material may be a consumable that moves used web material out of the way and moves unused web material to use for the subsequent service routine. The web material may be a textile, such as cloth, or made of other material appropriate for wiping a component of the print apparatus. Example textile web material of the service station may be woven fabric, non-woven fabric, fabric with synthetic layers, and the like.

Web material may wrinkle or wave up during operation, which may lead to a undesired contact between dirty cloth and a component of the apparatus which may contaminate the component and affect operation, for example. Consumable service materials, such as a web cloth, may be replaceable by a user and a user may incorrectly install the consumable material, which may lead to improper servicing or loss of function of the print apparatus.

Various examples described below relate to identification of proper routing of web material. A guide bar is used on a service station to provide tension on web material used for wiping. A sensor may use the guide bar as a reference to determine whether the web material is routed correctly on the service station. In this manner, the issue can be identified and the user may be informed about the condition of the web material in the service station.

The terms "include," "have," and variations thereof, as used herein, mean the same as the term "comprise" or appropriate variation thereof. Furthermore, the term "based on," as used herein, means "based at least in part on." Thus, a feature that is described as based on some stimulus may be based only on the stimulus or a combination of stimuli including the stimulus.

FIG. 1 is a side view depiction of an example service station system 102. The service station system 102 of FIG. 1 generally includes rollers 106 and 108, a spinnable bars 112 and 114, a wiper system 120, and a guide bar 104. Web material 110 may be coupled the rollers 106 and 108 to form a path of web material between the roller 106 and the roller 108. A plurality of spinnable bars (e.g., 112 and 114) may be placed on a carriage of the service station system 102 to form the path. In FIG. 1, the web material 110 routes along the spinnable bars to define the path of the web material on the side of the carriage of the service station system 102 for performing service.

The wiper system 120 may place a force on the web material 110 to place the web material 110 on the exposed servicing side into a service state. The wiper system 120 may provide a force on the web material during a wiper operation by moving a wiper blade towards the print carriage with the web material against an edge of the wiper and moves the wiper away from the print carriage after the wiper operation. In other examples, the wiper system 120 may include a roller in place of a blade or other differences based on implementation. In the example of FIG. 1, the wiper system 120 includes a blade that moves between a relatively higher vertical state for a service operation and relatively lower vertical state when a service routine is not being performed. The edge of the blade presses against the web material 110 routed between the spinnable bars 112 and 114 during a service operation to perform a service routine (e.g., press the web material 110 against a fluid ejection surface of a print head) and tension may be relieved on the web material 110 when the wiper system 120 moves to a non-servicing position upon completion of the service routine.

The guide bar 104 is placed to provide tension on the web material 110 on the exposed service side of the service station system 102. This may be due to placing the guide bar 104 in a displaced position with respect to a plane defined by the centers of the plurality of spinnable bars 112 and 114. For example, the spinnable bars 112 and 114 may be located such that the guide bar 104 is not parallel to the spinnable bars relative to the height position. By locating the guide bar 104 in a position to provide tension due to displacement with respect to the locations of the spinnable bars, tension may be provided on the web material in a non-servicing state and during a servicing state. Constant tension may avoid undesired movement of the web material against a moving print carriage, for example, and thus, may avoid contamination of a fluid ejection device with undesired excess print fluid from used web material 110. The guide bar 104 may be located along the web material path (e.g., between bars) to allow the lifting mechanism of the wiper system 120 to act properly.

The guide bar 104 may be optically different from the web material 110. As discussed further herein, a sensor may be used to identify a difference in an expected signal corresponding to the guide bar 104 (e.g., when the web material 110 is routed below the guide bar 104) and a signal corresponding to the web material 110 (e.g., when the web material 110 is routed above the guide bar 104). For example, the sensor may be an optical sensor that converts reflected light into an electrical signal and the web material 110 may reflect a particular range of wavelength different from the range of wavelengths reflected by the guide bar 104. In that example, the guide bar 104 and the web material 110 may be different colors, such as the guide bar being a dark color and the web material being a white color. The sensor and/or a controller may perform guide bar verification operations by determining the optical difference between the guide bar 104 and the web material 110 based on the sensor data.

Figure 2:
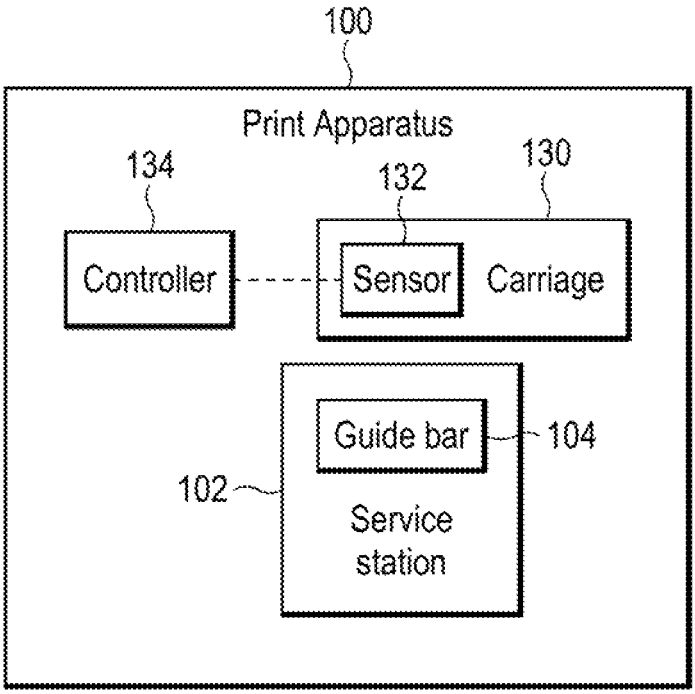
FIG. 2 is a block diagram of an example print apparatus.

FIG. 2 is a block diagram of an example print apparatus 100. The print apparatus 100 of FIG. 2 generally includes a service station 102 with a guide bar 104, a sensor 132 mounted to a carriage 130, and a controller 134 coupled to the sensor 132. The carriage 130 may be a print carriage of a print apparatus 100 where the print carriage 130 comprises a support to place a fluid ejection device, such as a carriage that supports a plurality of thermal inkjet print heads. The carriage 130 may be moveable along a print zone of the print apparatus 100 and moveable to a service position located with reference to the service station system 102, such as a position to a side of the print zone.

The sensor 132 includes circuitry, such as a photodiode, that is capable of sensing a difference between the guide bar 104 and web material, such as web material 110 of FIG. 1. For example, the sensor 132 may be an optical sensor capable of generating data corresponding to an amount of light received by a photodiode. Such a sensor may be an optical sensor capable of generating data corresponding to print head alignment by being located on a print carriage and taking readings as the print carriage moves to particular locations within the print apparatus 100. In other examples, the sensor 132 may be a distance sensor.

The controller 134 may be a combination of circuitry and executable instructions representing a control program to perform a guide bar verification operation (e.g., a verification of which side of the guide bar the web material is routed on). The controller 134 may use data from the sensor 132 to identify that the web material is incorrectly routed with reference to the guide bar 104. For example, a reference signal pattern may be stored on memory of the controller 134 and the controller 134 may execute instructions to compare data received from the optical sensor 132 to the reference signal data pattern and cause a notification to indicate if the sensor data is not within the expected range of the reference signal data pattern. An example reference signal data pattern may correspond to a particular amount of reflected light associated with the guide bar 104 or may correspond to a distance from the sensor 132 and the sensed data may correspond to an amount of reflected light that is outside the expected range of the signal pattern or less than an expected distance from the sensor 132.

Figure 3:
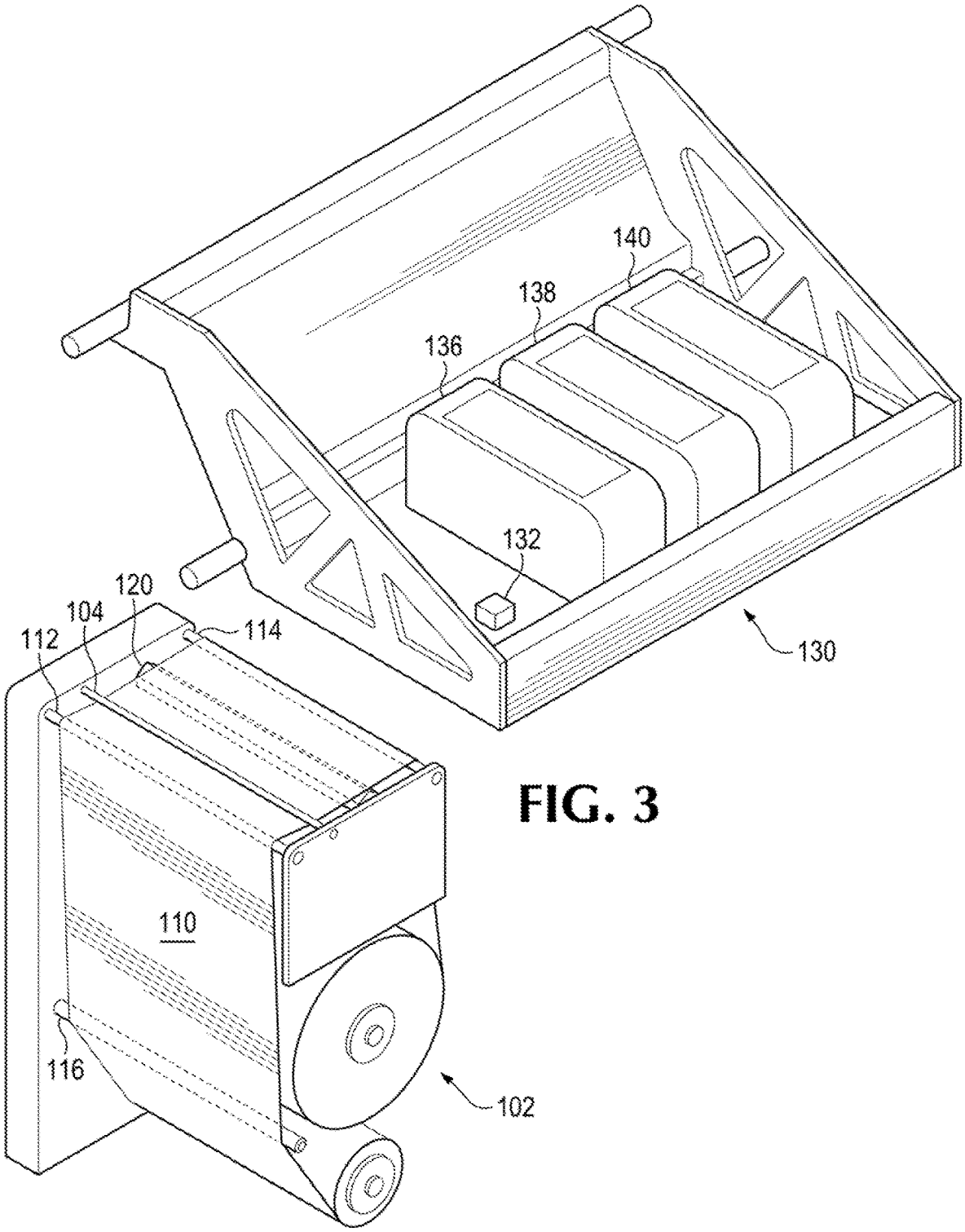
FIG. 3 is an isometric view of an example service station and an example print carriage of an example print apparatus.

FIG. 3 is an isometric view of an example service station system 102 and an example print carriage 130 of an example print apparatus 100. The print carriage 130 is aligned above the surface of the exposed web material 110 and able to move back and forth along the web material advance direction. Print heads 136, 138, and 140 are located on the print carriage 130 with the fluid ejection surface (not shown) facing towards the service station system 102. The guide bar 104 provides tension on the web material 110 away from the print carriage (e.g., away from the fluid ejection surface of the print heads). The example of FIG. 3 shows three spinnable bars 112, 114, and 116. The wiper system 120 includes a wiper blade below the web material that may move into an extended position above the service station system 102 to provide a force on the web material 110 to push the web material 110 towards the print carriage 130 (e.g., towards the fluid ejection surface of a print head).

The sensor 132 may be located on the print carriage 130 relative to the print head receiving area such that the sensor 132 may be located over the expected location of the guide bar 104 when a print head is located over the blade of the wiper system 120. In this manner, a verification operation to identify whether the guide bar 104 is visible by the sensor 132 may be performed when the print carriage 130 is in a servicing position (or before the print carriage is in a servicing position). In another example, the print controller may move the print carriage 130 to place the sensor 132 in the expected location of the guide bar 104 and move the print carriage 130 to a servicing position after the verification operation determines that the web material 110 is routed correctly with reference to the guide bar 104.

Figure 4:
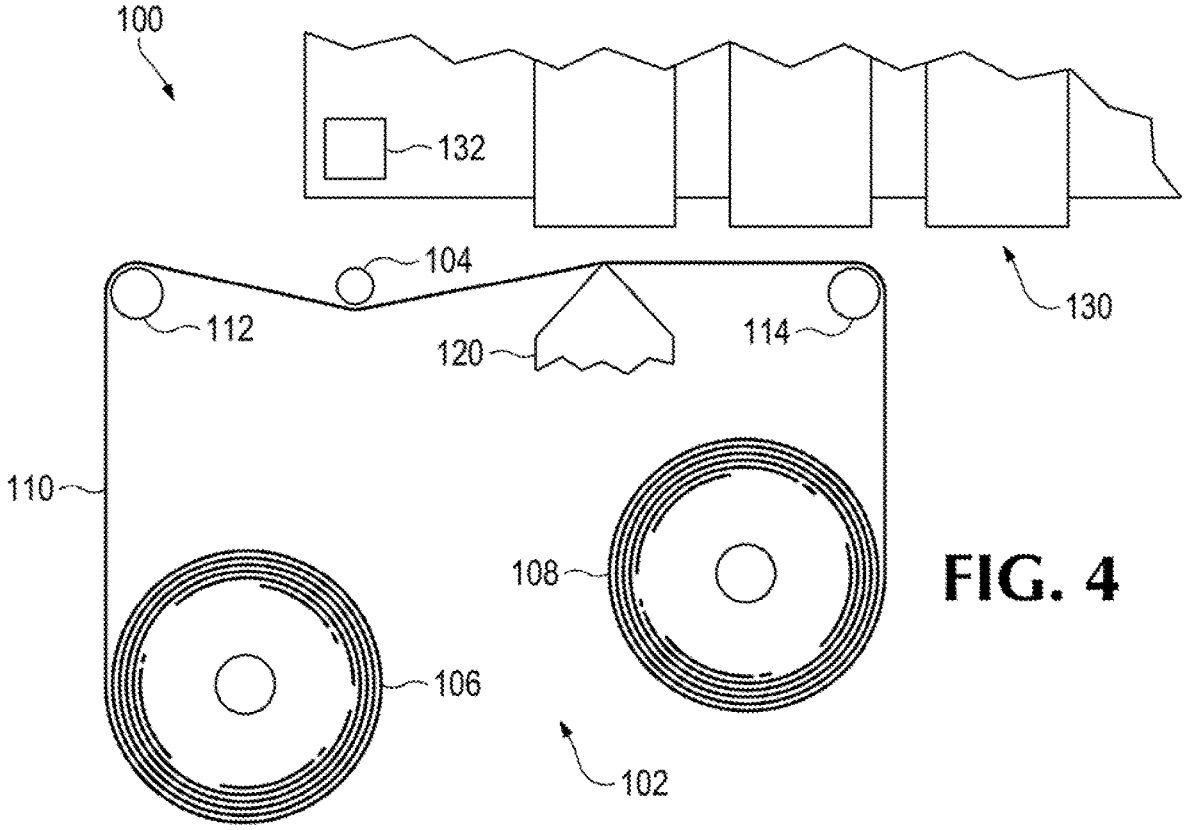
FIGS. 4 and 5 are side view depictions of an example print apparatus.
Figure 5:
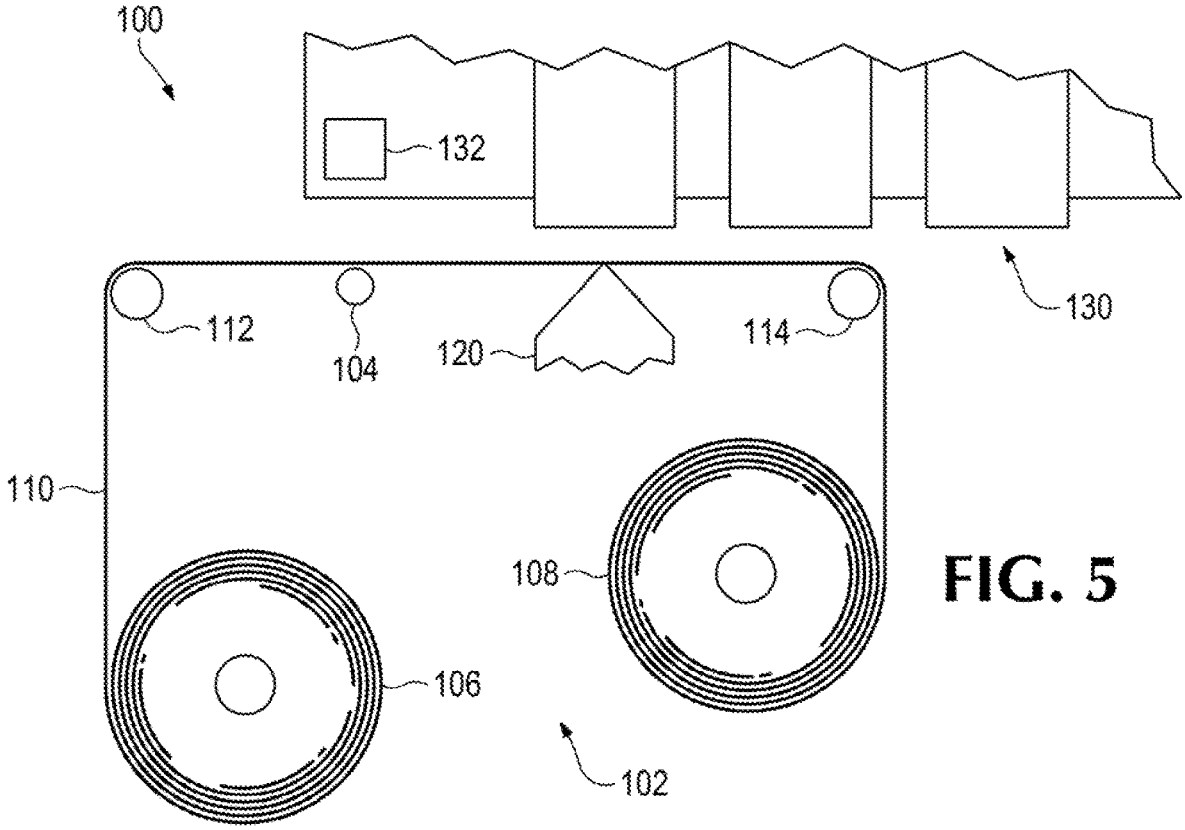

FIGS. 4 and 5 are side view depictions of an example print apparatus 100. FIG. 4 depicts an example orientation of the web material 110 when it is correctly routed with reference to guide bar 104 and the FIG. 5 depicts an example orientation of the web material 110 when it is incorrectly routed with reference to the guide bar 104. Referring to FIG. 4, the web material 110 is routed from the first roller 106, along the top of the first spinnable bar 112, along the side of the guide bar 104 that is opposite the sensor 132 and print carriage 130, along the top of the blade of the wiper system 120, along the top of the second spinnable bar 114, and onto the second roller 108. When the web material 110 is along the path defined in FIG. 4, the sensor 132 will read a signal of light reflected from the guide bar 104 because the web material 110 is routed on the far side of the guide bar 104 with reference to the sensor 132. The guide bar 104 may be displaced from a plane of the spinnable bars to alter the path of the web material 110 so that the web material 110 does not move in a straight path between the spinnable bars 112 and 114 (e.g., when the blade of the wiper system 120 is not in a servicing position).

Referring now to FIG. 5, the web material 110 is routed from the first roller 106, along the top of the first spinnable bar 112, along the side of the guide bar 104 that is facing the sensor 132 and print carriage 130, along the top of the blade of the wiper system 120, along the top of the second spinnable bar 114, and onto the second roller 108. When the web material 110 is along the path defined in FIG. 5, the sensor 132 may read a signal of light reflected from web material 110 because the web material 110 is routed on the near side of the guide bar 104 with reference to the sensor 132. As shown in FIG. 5, when the web material 110 is routed above the guide bar 104, tension may not be provided on the web material 110 away from the print heads and may allow, for example, the web material 110 to move vertically beyond a desired tolerance because the guide bar 104 is unable to stop the web material 110 from moving towards the print carriage 130.

Figure 6:
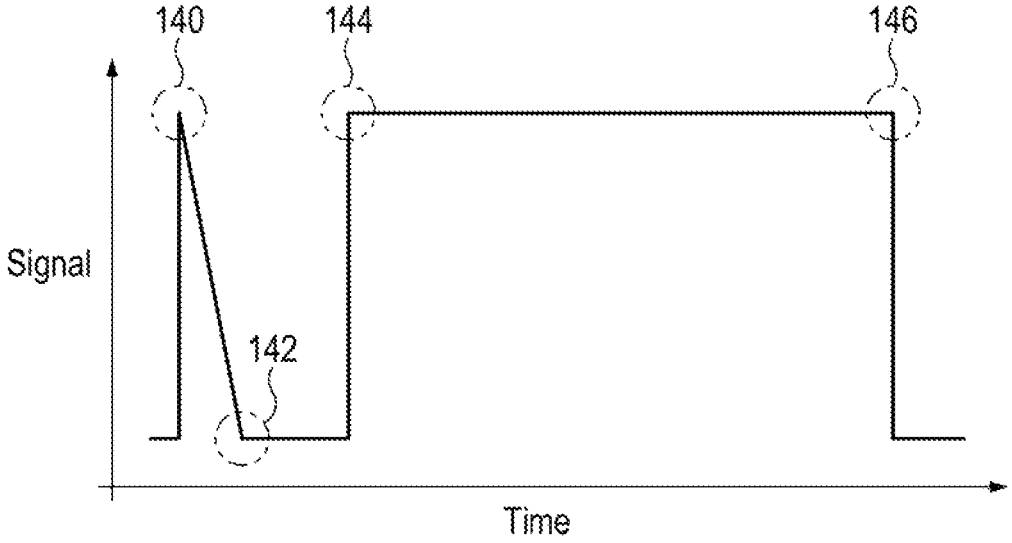
FIGS. 6 and 7 are example data signals of an example sensor used in an example print apparatus.
Figure 7:
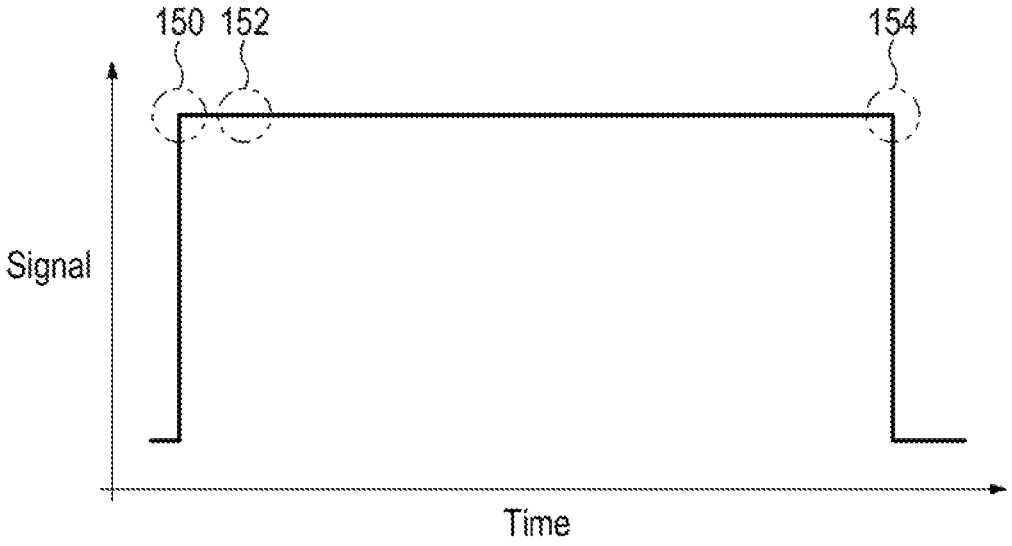

FIGS. 6 and 7 are example data signals of an example sensor used in an example print apparatus. The FIGS. 6 and 7 represent example situations (such as in the states depicted in FIGS. 4 and 5) where the sensor is activated to optically sense at a location range between the plurality of spinnable bars within a tolerance of at least the width of the guide bar. In the examples, the entire length of the web material exposed on the top of the service station is shown, but the range to, be analyzed is expected to focus on positions 142 and 152 which correspond to the expected position of the guide bar to be exposed on the top surface of the service station system.

Referring to FIG. 6, peaks of the signal are shown at positions 140 and 144 with a valley of the signal shown at position 142. A signal of the web material is indicated by the substantially steady signal line between positions 144 and 146. The peak and/or valley analysis of the signal may indicate that an object (e.g., a guide bar) entered the sensor's viewing area at position 142 and then left at position 144. Such an example signal of FIG. 6 may indicate that a guide bar was observed and that the web material is routed on the far side of the guide bar with reference to the location of the sensor.

Referring to FIG. 7, the signal stays substantially steady across signal positions 150, 152, and 154. This may indicate that web material is reflected along the entire exposed servicing side of the service station. In particular, a valley (such as the valley at position 142 in FIG. 6) may be the expected signal data and the expected signal data is compared to the sensed signal changes around position 152 where no valley in the signal data is indicated. Therefore, the signal analysis of the signal data of FIG. 7 may indicate the web material is observed at expected position 152 and that the web material is routed on the near side of the guide bar with reference to the location of the sensor. The sensor (or a controller coupled to the sensor) may use data restricted to the location range that includes the expected location of the guide bar, which in these examples are positions 142 and 152 in FIGS. 6 and 7. In that example, the range of error is isolated to the expected location of the guide bar as to avoid false positives of something else generating the expected peak-valley signal. A noise tolerance may also be used to filter identification of signal changes and avoid generating false positives.

Figure 8:
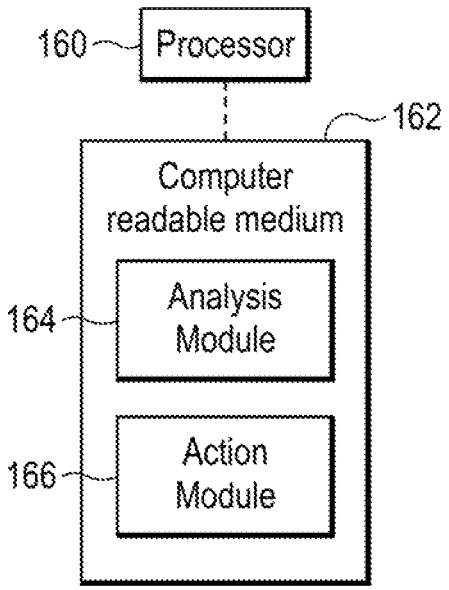
FIG. 8 is a block diagram depicting an example computer-readable medium and an example processor.

FIG. 8 is a block diagram depicting that a service station system 102 may comprise an example computer readable medium 162 and an example processor 160. The processor 160 may execute instructions 164 and 166 stored on the computer readable medium to perform guide bar verification operations as discussed above. For example, the controller 134 of FIG. 2 may include a processor 160 and a medium 164 with instructions that when executed to cause the processor 160 to perform the guide bar verification operations.

Referring to FIG. 8, the computer readable medium 162 is a memory resource that may contain a set of instructions that are executable by a processor resource, such as processor 160. The set of instructions are operable to cause the processor resource to perform operations of the system when the set of instructions are executed by the processor resource. The set of instructions stored on the memory resource may be represented as an analysis module 164 and an action module 166. The analysis module 164 represents program instructions that, when executed, cause the processor 160 to perform signal analysis operations and the action module 166 represents program instructions that, when executed, cause the processor 160 to control actions of the service station and/or print apparatus, such as move the sensor to an expected location of the guide bar and provide a notification to a control panel of the print apparatus based on the signal analysis performed when executing the analysis module 164. The processor resource may carry out a set of instructions to execute the modules 164, 166, and/or any other appropriate operations among and/or associated with the systems discussed herein. The processor resource may execute instructions on a memory resource to perform functionalities described herein in relation to any of FIGS. 1-7 and 9 or any subset or combination thereof. For example, the processor 160 may carry out a set of instructions to move a sensor across a distance corresponding to an expected location of a guide bar of a service station and determine whether web material is routed on a first side of a guide bar or a second side of the guide bar based on data generated from the sensor at the expected location of the guide bar.

A processor resource is any appropriate circuitry capable of processing (e.g., computing) instructions, such as one or multiple processing elements capable of retrieving instructions from a memory resource and executing those instructions. For example, the processor 160 may be a central processing unit (CPU) that enables web material routing verification (e.g., guide bar verification) by fetching, decoding, and executing modules 164 and 166. Example processor resources include at least one CPU, a semiconductor-based microprocessor, a programmable logic device (PLO), and the like. Example PLDs include an application specific integrated circuit (ASIC), a field-programmable gate array (FPGA), a programmable array logic (PAL), a complex programmable logic device (CPLD), and an erasable programmable logic device (EPLD). A processor resource may include multiple processing elements that are integrated in a single device or distributed across devices. A processor resource may process the instructions serially, concurrently, or in partial concurrence.

The computer readable medium is a memory resource. A memory resource represents a medium to store data utilized and/or produced by the system. The medium is any non-transitory medium or combination of non-transitory media able to electronically store data, such as modules 164 and 166 and/or data used by the systems, such as received sensor data or reference signal data. For example, the medium may be a storage medium, which is distinct from a transitory transmission medium, such as a signal. The medium may be machine-readable, such as computer-readable. The medium may be an electronic, magnetic, optical, or other physical storage device that is capable of containing (i.e., storing) executable instructions. A memory resource may be a non-volatile memory resource such as read only memory (ROM), a volatile memory resource such as random access memory (RAM), a storage device, or a combination thereof. Example forms of a memory resource include static RAM (SRAM), dynamic RAM (DRAM), electrically erasable programmable ROM (EEPROM), flash memory, or the like. A memory resource may include integrated memory such as a hard drive (HD), a solid state drive (SSD), or an optical drive. A memory resource may be said to store program instructions that when executed by a processor resource cause the processor resource to implement functionality of the systems discussed herein. A memory resource may be integrated in the same device as a processor resource or it may be separate but accessible to that device and the processor resource. A memory resource may be distributed across devices.

Components of the systems discussed herein may be implemented in a number of fashions. Looking at FIG. 8, the executable instructions may be processor-executable instructions, such as program instructions, stored on the memory resource 162, which is a tangible, non-transitory computer-readable storage medium, and the circuitry may be electronic circuitry, such as processor resource 160, for executing those instructions. The instructions residing on a memory resource may comprise any set of instructions to be executed directly (such as machine code) or indirectly (such as a script) by a processor resource.

Figure 9:
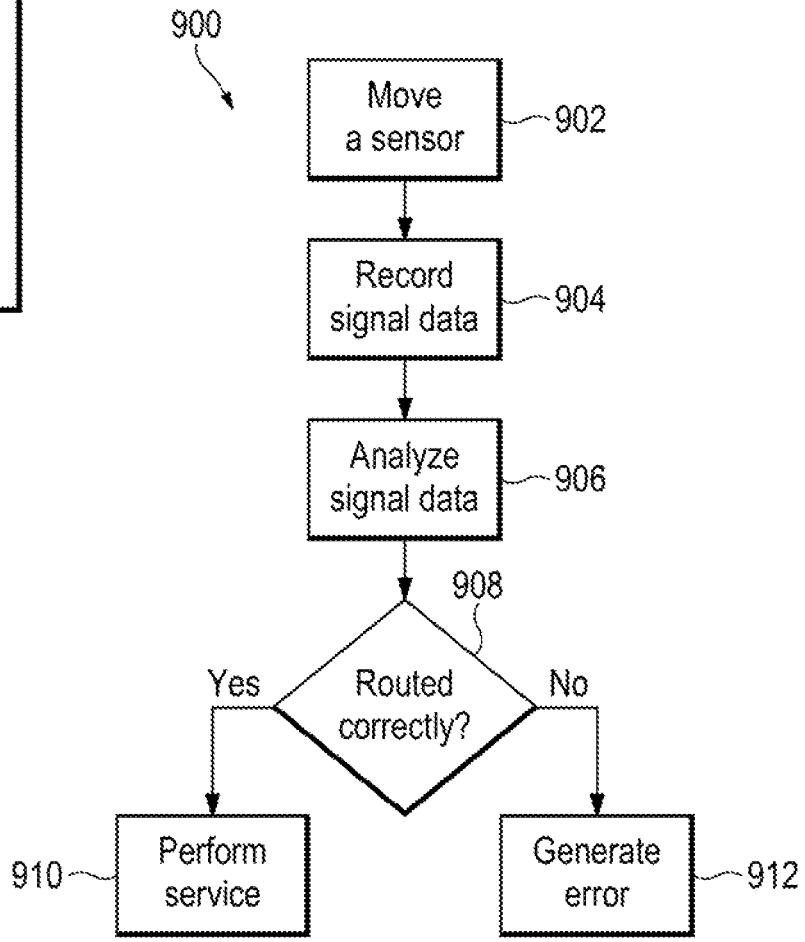
FIG. 9 is a flow diagram depicting an example method of determining routing of a web material with reference to a guide bar.

FIG. 9 is a flow diagram depicting an example method 900 of determining routing of a web material with reference to a guide bar. In general, the method 900 includes moving the sensor to an expected location of a guide bar of the service station and determining whether web material is routed correctly or incorrectly with reference to the guide bar based on the sensor data at the expected location of the guide bar.

At block 902, a sensor is moved across a distance corresponding to an expected location of a guide bar of a service station. The distance may be about the width of the guide bar starting at an expected position of the guide bar. For example, the sensor may be located about the same distance from the print head on the carriage as the guide bar is from the wiper system to service a print head.

At block 904, when the sensor is in a position corresponding to the expected location of the guide bar, the sensor records data corresponding to a signal received. For example, the sensor may be an optical sensor that records signals based on light reflected towards the sensor. For another example, the sensor may be a distance sensor that records signals based on the distance of an object from the sensor.

At block 906, the recorded signal data corresponding to the expected location of the guide bar is analyzed with respect to whether there is a change in signal across the distance corresponding to the expected location of the guide bar. For example, a peak and/or valley of the signal data (e.g., a signal change in excess of a noise threshold) across the distance may indicate a change in object or position of the service station where as a substantially flat signal (e.g., a signal change within a noise threshold) may indicate the same object has been detected across the sensed distance. The peak-to-peak or valley-to-peak analysis may take into consideration a noise threshold, where a guide bar is indicated when the peak-to-valley change is beyond a noise threshold to avoid false positives indicating the guide bar. In an example where the sensor data indicates distance, analysis of the recorded data may include identifying a distance of the web material from the sensor using sensor data at the expected location of the guide bar and comparing the identified distance of the web material to an expected distance (e.g., a known distance) of the guide bar from the sensor.

At block 908, the signal analysis is used to identify whether the web material is routed correctly or not. If the web material is determined to be routed correctly based on the signal data (e.g., the signal data indicates the web material is routed on the side of the guide bar opposite the print carriage so that the guide bar is showing towards the sensor), a fluid ejection device service operation may be performed at block 910. If the web material is determined to be routed incorrectly based on the signal data (e.g., the signal data indicates the web material is routed on the side of the guide bar towards the print carriage so that the guide bar is hidden from the sensor by the web material), an error message is generated at block 912. The error message may be presented on a control panel of the print apparatus, entered into a log stored on the print apparatus, sent as an email to a user account, and/or otherwise communicated. Communication of the error message allows for a user to open the print apparatus to access the service station and reroute the web material, which may avoid undesired contamination of the fluid ejection device if service was to be performed when the web material is routed incorrectly.

Although the flow diagram of FIG. 9 illustrates specific orders of execution, the order of execution may differ from that which is illustrated. For example, the order of execution of the blocks may be scrambled relative to the order shown. Also, the blocks shown in succession may be executed concurrently or with partial concurrence. All such variations are within the scope of the present description.

All of the features disclosed in this specification (including any accompanying claims, abstract and drawings), and/or all of the elements of any method or process so disclosed, may be combined in any combination, except combinations where at least some of such features and/or elements are mutually exclusive.

The present description has been shown and described with reference to the foregoing examples. It is understood, however, that other forms, details, and examples may be made without departing from the spirit and scope of the following claims. The use of the words "first," "second," or related terms in the claims are not used to limit the claim elements to an order or location, but are merely used to distinguish separate claim elements.

What is claimed is:

1. A print apparatus comprising:

a service station comprising:

a guide bar;

a sensor mounted to a carriage, the sensor capable of optically sensing a difference between the guide bar and a web material; and a controller to use data from the sensor to identify that the web material is incorrectly routed with reference to the guide bar.

2. The apparatus of claim 1, wherein the service station further comprising:

a plurality of spinnable bars, the guide bar located between the plurality of spinnable bars.

3. The apparatus of claim 2, wherein the carriage is a print carriage and the apparatus further comprising:

a wiper system to provide a force on the web material towards the print carriage.

4. The apparatus of claim 3, wherein:

the wiper system provides the force on the web material during a wiper operation by moving a wiper towards the print carriage with the web material against an edge of the wiper; and the wiper system moves the wiper away from the print carriage after the wiper operation.

5. The apparatus of claim 4, wherein the service station further comprises:

a first web roller; and a second web roller, the web material to route from a path between the first web roller to the second web roller with the plurality of spinnable bars along the path.

6. The apparatus of claim 2, wherein:

the guide bar is displaced from a plane of the plurality of spinning bars.

7. The apparatus of claim 2, wherein:

the sensor is activated to optically sense at a location range between the plurality of spinnable bars within a tolerance of the guide bar; and the controller uses data restricted to the location range that includes the expected location of the guide bar.

8. The apparatus of claim 1, wherein:

the sensor is an optical sensor capable of generating data corresponding to print head alignment.

9. The apparatus of claim 1, wherein:

the guide bar is to provide tension on the web material when routed on a side of the guide bar opposite to the carriage.

10. The apparatus of claim 1, wherein the web material has a lighter color than the guide bar.

11. A service station system comprising:

a first roller and a second roller, the first roller and the second roller to form a path of web material between the first roller and the second roller when the web material is coupled to the first roller and the second roller;

a plurality of spinnable bars, the web material to route along the plurality of spinnable bars between the first roller and the second roller;

a wiper system with a blade edge to press, during a service operation, against the web material routed among the plurality of spinnable bars;

a guide bar located among the spinnable bars, the guide bar to provide tension on the web material due to displacement of the guide bar with respect to a plane on which the plurality of spinnable bars is located; and a sensor to detect a position of the web material with respect to the guide bar.

12. The system of claim 11, wherein the guide bar is optically different from the web material, the system further comprising:

the sensor being an optical sensor to optically sense a difference between the guide bar and the web material; and a controller to determine from output of the sensor whether the web material is incorrectly routed with reference to the guide bar.

13. The system of claim 12, wherein the controller is to compare data received from the sensor to a reference signal data pattern to determine whether the web material is incorrectly routed with reference to the guide bar.

14. The system of claim 11, wherein the sensor is a distance sensor.

15. The system of claim 11, further comprising a carriage supporting the sensor, the carriage to move the sensor to an expected location of the guide bar.

16. The system of claim 15, wherein the sensor is spaced from a print head on the carriage by a same distance as that between the guide bar and the wiper system.

17. A non-transitory computer-readable storage medium comprising a set of instructions executable by a processor resource to:

move a sensor across a distance corresponding to an expected location of a guide bar of a service station; and determine whether web material is routed on a first side of a guide bar or a second side of the guide bar based on data generated from the sensor at the expected location of the guide bar.

18. The medium of claim 17, wherein the set of instructions is executable by the processor resource to:

perform a print head service operation in response to a determination that the web material is routed on the first side of the guide bar; and generate an error message in response to a determination that the web material is routed on the second side of the guide bar.

19. The medium of claim 17, wherein the set of instructions is executable by the processor resource to:

record signal data when the sensor is positioned to sense the expected location; and analyze the recorded signal data corresponding to the expected location with respect to whether there is a change in the signal across the distance corresponding to the expected location of the guide bar.

20. The medium of claim 17, wherein the set of instructions is executable by the processor resource to:

identify a distance of the web material from the sensor using data taken by the sensor when at the expected location of the guide bar; and compare the identified distance of the web material to an expected distance of the guide bar from the sensor.

* * * * *